United States Patent [19]

Cornette

[11] Patent Number: 4,621,558

[45] Date of Patent: Nov. 11, 1986

[54] PERMANENTLY RESIDING OR REMOVABLE CAPO

[76] Inventor: Swany D. Cornette, Rte. 1, Paint Lick, Ky. 40461

[21] Appl. No.: 730,848

[22] Filed: May 6, 1985

[51] Int. Cl.[4] ..... G10D 3/04

[52] U.S. Cl. ..... 84/318

[58] Field of Search ..... 84/318

[56] References Cited

U.S. PATENT DOCUMENTS

| | | | |
|---|---|---|---|
| 7,279 | 4/1850 | Ashborn | 84/318 |
| 583,102 | 5/1897 | Utt | 84/318 |
| 743,054 | 11/1903 | Bergren | 84/318 |
| 4,252,046 | 2/1981 | Myerson et al. | 84/318 |

FOREIGN PATENT DOCUMENTS

| | | | |
|---|---|---|---|
| 277458 | 9/1927 | United Kingdom | 84/318 |

*Primary Examiner*—Lawrence R. Franklin

[57] ABSTRACT

A rolling capo device comprises two rollers movable along the neck of a guitar. The top roller presses the strings at any of several frets in order to facilitate playing in various keys. The rollers fit the cross-sectional curvature of the neck, thus maintaining a true transverse position and facilitate a smooth travel of the device up and down the neck.

4 Claims, 2 Drawing Figures

FIG. 1
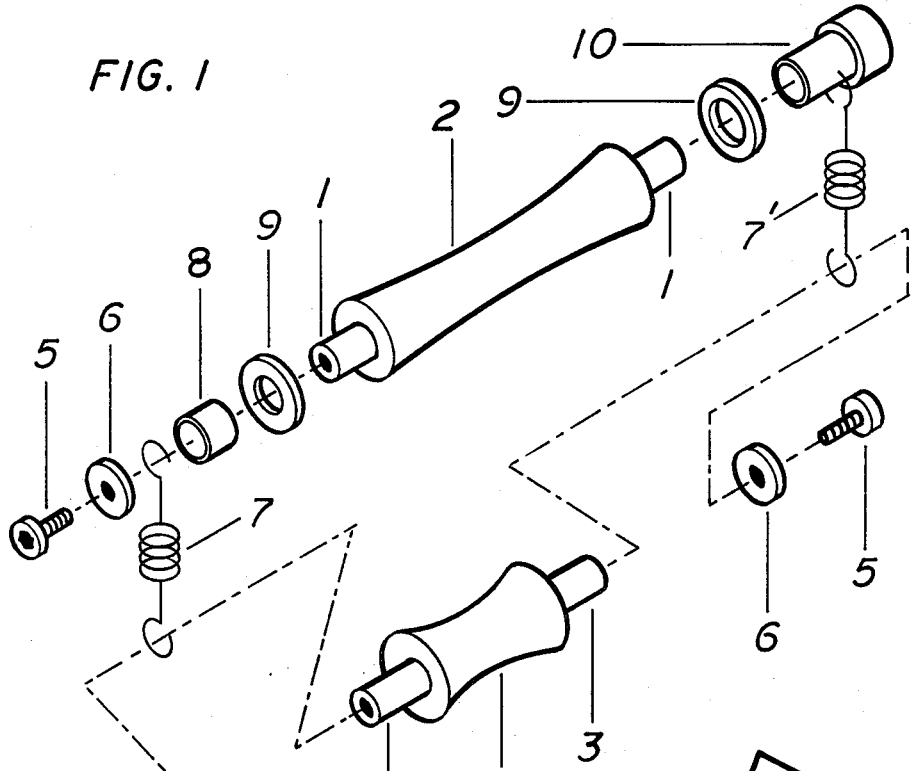
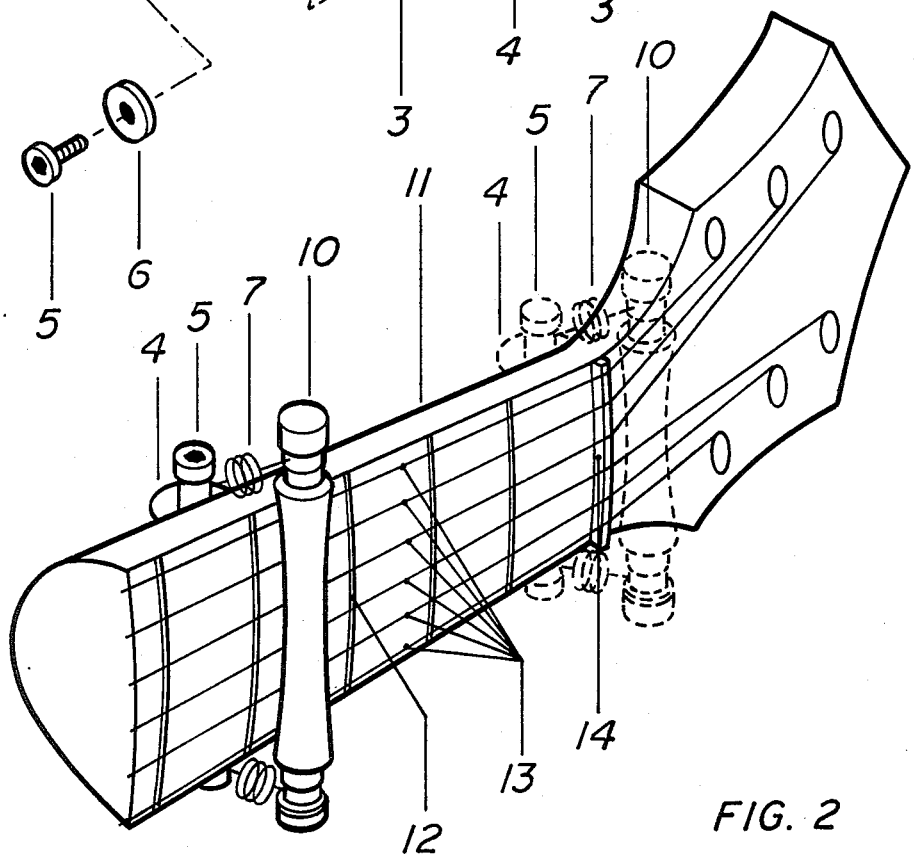
FIG. 2

PERMANENTLY RESIDING OR REMOVABLE CAPO

The present invention relates to a new and beneficial improvement in rolling capo devices for use on a guitar or the like.

BACKGROUND OF THE INVENTION

The prior art capos of the movable type are, to the best of my knowledge, represented by the patents to Averitt U.S. Pat. No. 620,560; Knaffl U.S. Pat. No. 134,679, and Bergren U.S. Pat. No. 743,054. All these devices require modifications of the guitar necks to accomodate the capos as disclosed. The disadvantage of playing an instrument with one of these modifications is believed to be manifest.

On the other hand, the present invention is not merely adaptable to a standard guitar neck, it operates thereon in a surprisingly advantageous manner, being capable of smooth transfer from one position to another.

BRIEF DESCRIPTION OF THE DRAWINGS

FIG. 1 is an exploded view of the components of the invention.

FIG. 2 shows the invention mounted on a guitar neck.

As shown in the drawings, numeral 2 designates the top roller which can be made of rubber or the like. The surface of the said roller should be shaped to make a line contact with the top of the fretted surface of the neck, since most guitars necks have rounded fretboards.

The bottom roller 4 is similarly shaped and makes a line contact with the back of the neck.

Top roller 2 fits on rod 1. Washer 9, sleeve 8, and the looped end of tension spring 7 rotatably slide over the left end of rod 1 (as seen in FIG. 1) and are held in place by washer 6 and Allen screw 5. The looped end of tension spring 7' fastens through holes in cap 10. Washer 9 and cap 10 slip onto rod 1. Rod 1 rotates within cap 10.

Bottom roller 4 fits onto rod 3. Lower loop end of 7 slips onto rod 3 and is rotatably secured by washer 6 and Allen screw 5 at each end of roller 4.

When mounted on the guitar neck 11, as shown in FIG. 2, the springs 7 and 7' bias the rollers so that they snugly fit the top and bottom sides of the neck. As shown in FIG. 1, rod 1 is longer than rod 3. This causes the tension springs 7 and 7' to pull inwardly, thereby retaining cap 10 on the end of rod 1.

The presently described glider-type capo, when mounted on the guitar or the like, can readily be moved from storage position behind nut 14 to any position between nut 14 and body of guitar, or the like.

Whenever the musician wishes to play in another key, he merely pushes the capo along the neck without encountering any jerky or otherwise unsteady movement.

No guides, tracks, grooves or other clumsy additions to or modification of the neck are necessary.

The presently described capo maintains its true transverse position because the roller curvatures match those of the instrument neck. To understand this function, one may imagine that for some unlikely reason the capo is twisted out of its normal transverse position thus contacting the neck only at the edges and leaving gaps between the rollers and the neck at their middle portions. The tension springs would then supply a force tending to right the roller positions and whenever the capo is moved, the rollers would glide back into their original posture. The operation is remarkably smooth.

Another advantage in this device is that it can be left in a storage position behind the nut without affecting the musical key. While in this position, the effect on the instrument would be the same as if it had been removed.

It should also be noted that roller 2 applies equal pressure to all the strings.

What is claimed is:

1. A capo device for use on the neck of a stringed musical instrument, said neck having a top surface with a fingerboard thereon and a curved bottom surface, and strings tensioned over said neck, said capo comprising:

an elongated top roller having a length sufficient to transversely span said fingerboard and a cylindrical surface which matches the transverse curvature of said fingerboard;

an elongated bottom roller having a concave cylindrical surface which makes a line contact with a substantial portion of the transverse curvature of said curved bottom surface; and tension means connecting said top and bottom rollers to force said rollers toward one another to stop said string at various positions on said fingerboard.

2. The capo as recited in claim 1 wherein said top and bottom rollers are fit onto rods and said tension means includes two tension springs connecting, respectively, adjacent ends of said rods.

3. The capo as recited in claim 1 wherein said tension means include means permitting said rollers to rotate simultaneously.

4. The capo as recited in claim 3 further including a cap rotatably receiving one end of the top roller's rod and said tension means consists of two tension springs, one tension spring having two looped ends rotatably receiving adjacent rod ends and the other tension spring having one end fastened to said cap and the other end having a looped end rotatably receiving the adjacent end of said bottom roller's rod.

* * * * *